US005379876A

United States Patent [19]

Hutton

[11] Patent Number: 5,379,876

[45] Date of Patent: Jan. 10, 1995

[54] COIN DISCRIMINATION APPARATUS

[75] Inventor: Les Hutton, Rochdale, England

[73] Assignee: Coin Controls Limited, Oldham, England

[21] Appl. No.: 949,241

[22] PCT Filed: Apr. 30, 1991

[86] PCT No.: PCT/GB91/00685

§ 371 Date: Apr. 28, 1993

§ 102(e) Date: Apr. 28, 1993

[87] PCT Pub. No.: WO91/18372

PCT Pub. Date: Nov. 28, 1991

[30] Foreign Application Priority Data

May 14, 1990 [GB] United Kingdom ..... 9010766

[51] Int. Cl.[6] ..... G07D 5/08

[52] U.S. Cl. ..... 194/319

[58] Field of Search ..... 194/319, 318, 317

[56] References Cited

U.S. PATENT DOCUMENTS 4,845,994 7/1989 Quinlan, Jr. ..... 194/317

FOREIGN PATENT DOCUMENTS 0384375 8/1990 European Pat. Off. ..... 194/317

2169429 7/1986 United Kingdom ..... G07D 5/08

*Primary Examiner*—F. J. Bartuska

*Attorney, Agent, or Firm*—Morgan & Finnegan

[57] ABSTRACT

In coin discrimination apparatus, a coin under test rolls past first and second inductive sensors (C1, C2) which produce first and second coin signals ($x_1$, $x_2$) in dependence upon the coin under test. The coin signals are compared with data defining first and second stored windows ($W_1$, $W_2$) to determine acceptability of the coin. In accordance with the invention the data for the first and second windows ($W_1$, $W_2$) are stored respectively for providing both a first and a second window width ($W_{11}$, $W_{12}$; $W_{21}$, $W_{22}$), wherein the first window width corresponds to the width of a distribution of coin signals associated with acceptable coins of a particular denomination, and the second window width corresponds to the width of said distribution but excludes therefrom a range of values corresponding to fraudulent coins, and a coin under test is deemed to be acceptable upon the coin signals falling either within a first or a second acceptance condition wherein, for the first acceptance condition, the value of the first coin signal fails within the first window width of the first window ($W_{11}$), and the value of the second coin signal falls within the second window width of the second window (W22), and for the second acceptance condition the value of the first coin signal falls within the second window width of the first window ($W_{12}$), and the value of the second coin signal falls within the first window width of the second window ($W_{21}$).

10 Claims, 3 Drawing Sheets

Sensor C1

Sensor C3

Sensor C2

COIN DISCRIMINATION APPARATUS

Figure 1:
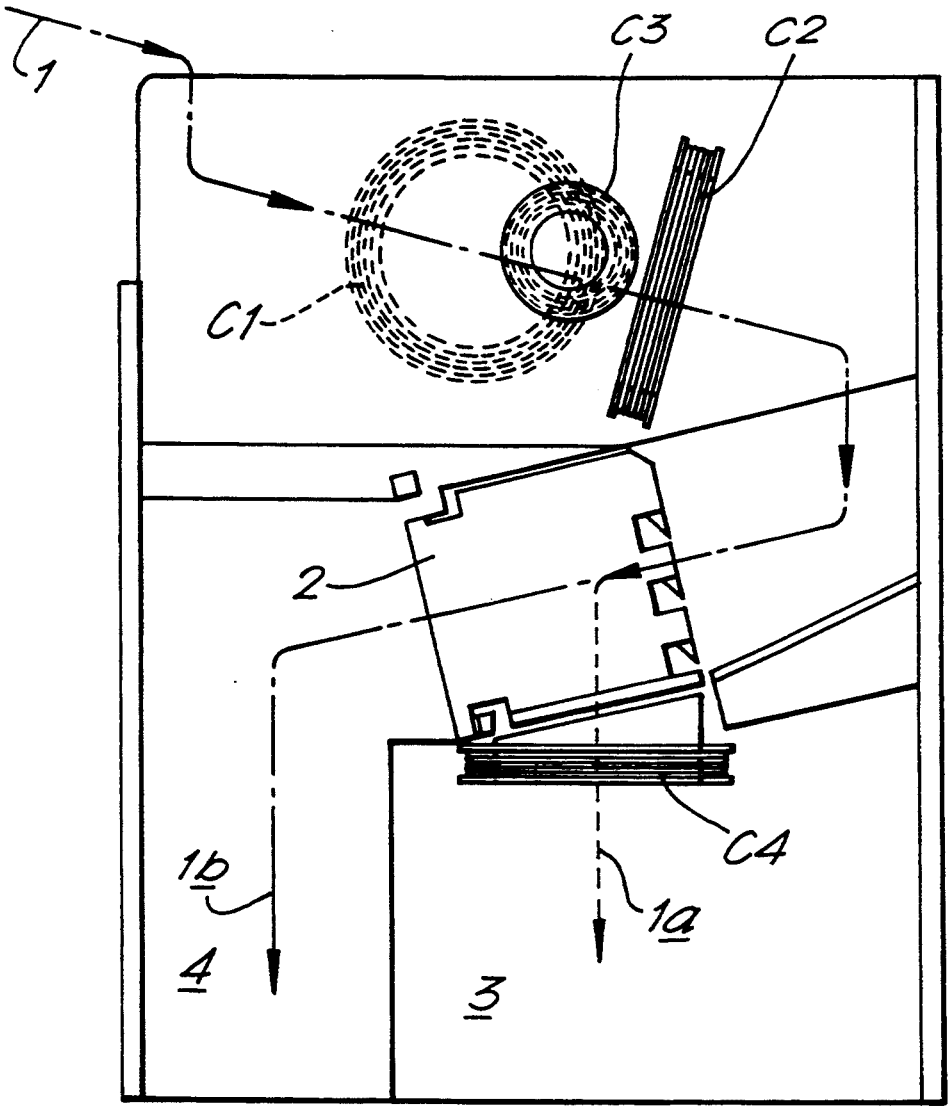

This invention relates to coin discrimination apparatus with improved discrimination between true and fraudulent coins and has particular but not exclusive application to a multi-coin validator.

In a conventional multi-coin validator coins pass along a path past a number of sensor means in the form of a coils which are energised to produce an inductive coupling with the coin. The degree of interaction between the coin and the coil is a function of the relative size of the coin and coil, the material from Which the coin is made and also its surface characteristics. Thus by monitoring the change in impedence presented by each coil, data indicative of the coin under test can be provided. The data can be compared with information stored in a memory to determine coin denomination and authenticity.

Our UK Specification 2 169 429 discloses coin discrimination apparatus utilising a plurality of inductive sensor coils which are each included in a respective resonant circuit. The resonant circuits are driven by a variable frequency oscillator through a multiplexer. As the coin passes a particular coil, the natural resonant frequency of the resonant circuit is altered due to the inductive coupling between the coin and the coil. The circuit is maintained at its natural resonant frequency by means of a phase locked loop which alters the frequency of the oscillator so as to track the natural resonant frequency of the resonant circuit during passage of the coin passed the coil. As a result, the amplitude of the oscilatory signal developed across the resonant circuit varies substantially on a transitory basis. The amplitude deviation produced by passage of the coin past the coil is a function of the coin denomination. It has been found that by using three coils of different sizes and configurations, three coin signals can be provided which uniquely characterise coins of a particular coin set e.g. the UK coin set.

The amplitude deviations produced by the three coils are digitised to produce the coin signals and are then compared with reference values stored in a programmable memory in order to discriminate between coins of different denominations, and frauds.

The data stored in the programmable memory is arranged to define windows of acceptable values for the coin signals. The windows are required because true coins of a particular denomination exhibit minor deviations in the values of the coin signals from coin to coin and the windows are selected so as to encompass the range of values normally expected from coins of a particular denomination.

A coin is determined to be acceptable if the coin signals produced from the respective sensor coils each lie within the range of values defined by the windows stored in the memory.

A problem arises that certain fraudulent coins e.g. a coin of a foreign coin set may have corresponding windows which overlap the windows of an acceptable coin, making it difficult to discriminate between a fraudulent and true coin.

The present invention provides a solution to this problem. In accordance with the present invention, first and second window widths are stored for each of first and second windows associated with the coin signals from first and second of the sensor means, the first window width corresponding to the width of a distribution of coin signals associated with acceptable coins of a particular denomination, and the second window width corresponding to the width of the distribution but excluding therefrom a range of values corresponding to fraudulent coins, and a coin under test is deemed to be acceptable upon the coin signals falling within the either a first or a second acceptance condition, wherein for the first acceptance condition, the value of the first coin signal falls within the first window width of the first window, and the value of the second coin signal falls within the second window width of the second-window, and for the second acceptance condition, the value of the first coin signal falls within the second window width of the first window, and the value of the second coin signal falls within the first window width of the second window.

Thus, in accordance with the invention, two independent acceptance conditions are permitted, wherein for the first condition, the range of values of coin signal corresponding to a fraudulent coin is excluded from the second window and, for the second acceptance condition, the range of coin values for fraudulent coins for the second coin signal are excluded from the width of the first window. In this way, in accordance with the invention, a substantially improved rejection rate of fraudulent coins is achieved.

The invention may include a third sensor means which in operation produces a coin signal within a window width which is substantially the same both for fraudulent coins and for acceptable coins of the particular denomination.

Figure 2:
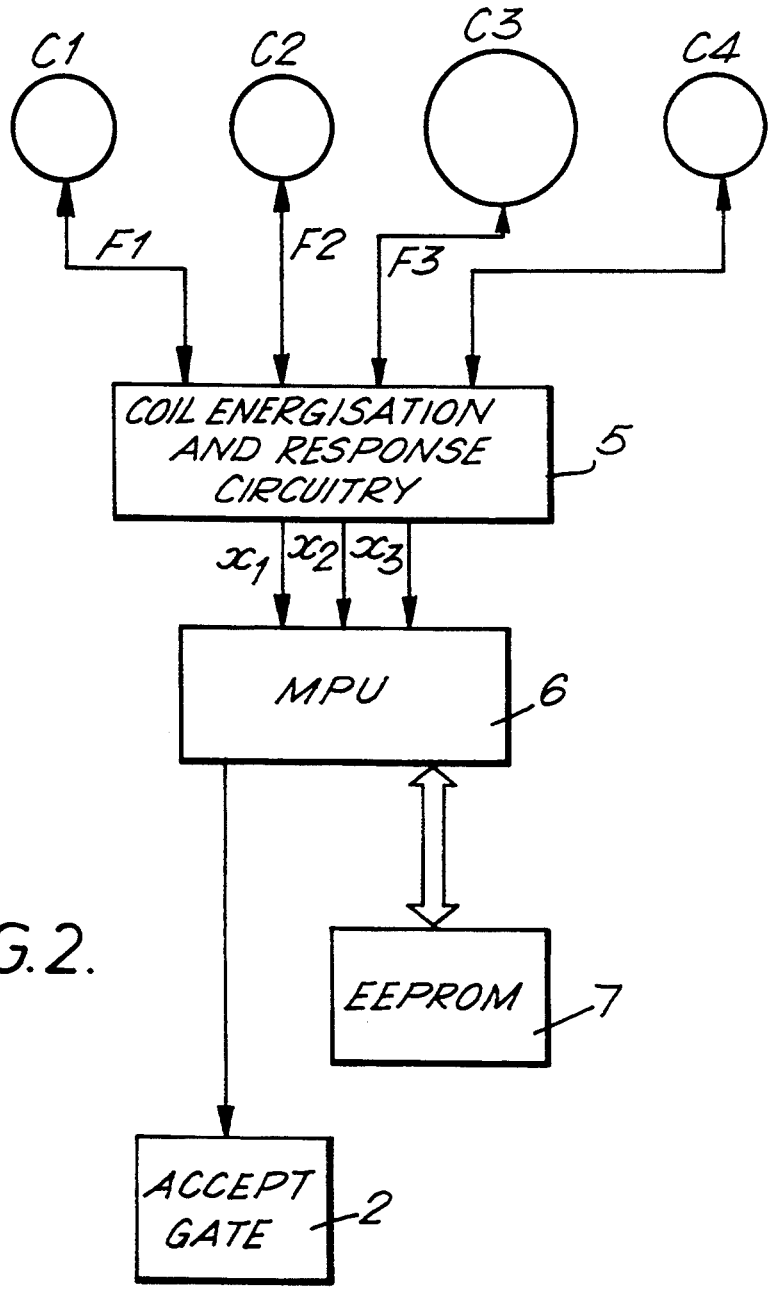
Figure 3A:
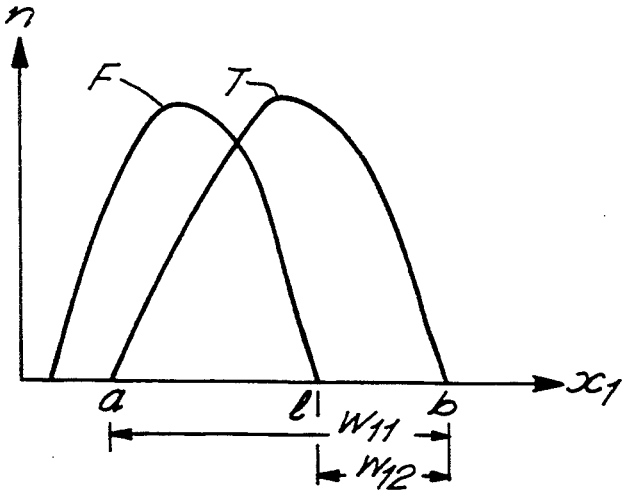
Figure 3B:
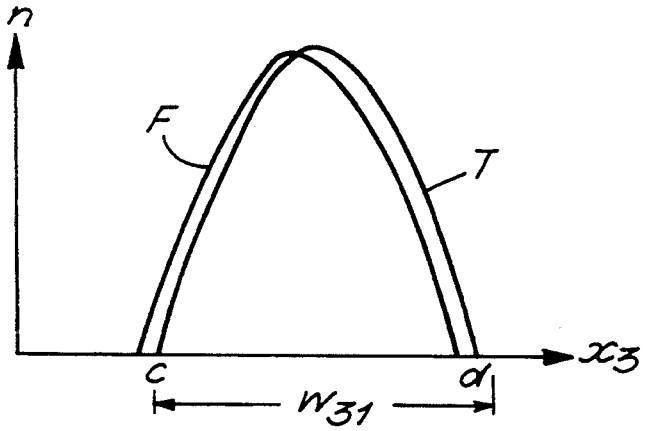
Figure 3C:
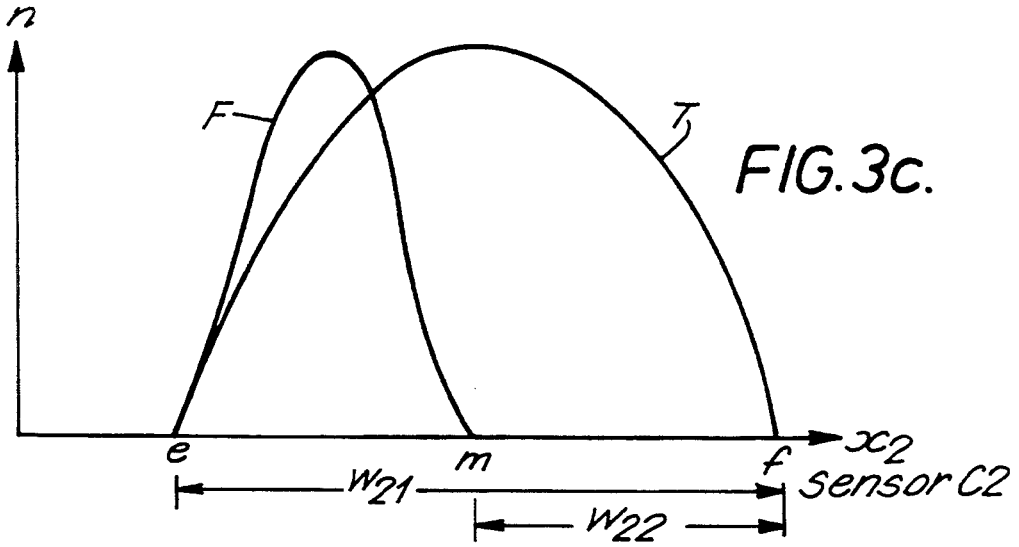

In order that the invention may be more fully understood an embodiment thereof will now be described with reference to the accompanying drawings in which:

FIG. 1 is a schematic view of a multi-coin validator in accordance with the invention;

FIG. 2 is a schematic circuit diagram of discrimination circuitry connected to the sensor coils shown in FIG. 1; and FIGS. 3*a*, 3*b*,and 3*c* consists of three graphs of coin population (n) plotted against the value of coin signal (x) produced for the sensor coils C1, C2, C3, for true coins T of a particular denomination and false coins F, in which the false coin distribution overlaps the true coin distribution.

Referring to FIG. 1, the apparatus consists of a coin path 1 along which coins under test roll edgewise past first, second and third sensor coils C1, C2, C3. If the coin detected by the sensor coils is identified to be a true coin, a solenoid operated accept gate 2 is opened to allow the coin to pass along path 1*a* down an accept chute 3. If the coin is identified to have non-acceptable characteristics such as a fraudulent coin, the gate 2 is not opened and the coin passes along path 1*b* to reject chute 4.

An accept coil C4 is provided in the accept chute 3, which is energised in such a manner as to detect the presence of acceptable coins.

Sensor coils C1, and C3 are disposed on opposite sides of the coin path 1 and the coil C2 is arranged to wrap around the path such that its axis is parallel to the length thereof. The three coils are energised at different but relatively close frequencies F1, F2, F3 in the KHz range.

This general configuration is described in more detail in our UK Patent Specification 2 169 429.

Referring to FIG. 2, the coils C1, C2, C3 are shown schematically, energised at their respective different frequencies F1, F2, F3 by means of drive circuitry 5. Each of the coils is connected in a respective resonant circuit and as the coin rolls passed the coil, eddy type inductive coupling occurs between the coin and the coil, so as to alter the impedence of the resonant circuit. This produces a change in frequency and/or amplitude of the signal developed in the resonant circuit and this change is a function of the coin under test. In our UK Patent Specification 2 169 429, a system is described in which the frequency of energisation of the coil is arranged to track the natural resonant frequency of the resonant circuit as the coin passes the coil, and in this way, a large amplitude deviation is produced, which can be monitored in order to provide an indication of coin denomination. Due to the differences in size and configuration of the three coils, C1, C2, C3 each coil produces a different value of peak amplitude deviation for a particular coin and the three peak amplitude deviations for a particular coin provide a substantially unique definition of the coin under test. Thus, by comparing the peak amplitude deviations with stored values indicative of acceptable coins, an indication of coin acceptability can be provided. Reference is directed to our Patent Specification aforesaid for a more detailed description of the manner in which the frequency tracking may be carried out. In FIG. 2 hereof, the circuitry for frequency tracking is indicated generally by the circuit 5, which provides outputs $c_1$, $c_2$, $c_3$ indicative of the amplitude developed by the coils C1, C2, C3 during passage of a coin under test, which are fed to a microprocessor 6.

The microprocessor operates in an idle mode in the absence of a coin under test so as to determine base values $c_{01}$, $c_{02}$, $c_{03}$, of the signals $c_1$, $c_2$, $c_3$. In response to a coin, the microprocessor switches to a coin sensing mode in which the values of the signals c are repetitively sampled as the coin passes the coils. As a result, the microprocessor can compute the peak deviations of the signals $c_1$, $c_2$, $c_3$ from the respective base values $c_{01}$, $c_{02}$, $c_{03}$ whilst the coin passes the coils. As previously explained, these peak deviation signals substantially uniquely characterise the coin under test and will be referred to herein as coin signals $x_1$, $x_2$, $x_3$ for the coils c1, c2, c3 respectively.

An EEPROM 7 contains stored values indicative of acceptable coins. The information is stored in terms of acceptance ranges or windows for the signals $x_1$, $x_2$, $x_3$ and an individual set of windows is provided for each coin denomination. It is necessary to provide windows because the characteristics of individual coins of a particular denomination vary slightly from coin to coin. Thus, for an individual coin denomination, stored windows $W_1$, $W_2$, $W_3$ are provided for comparison with the coin signals $x_1$, $x_2$, $x_3$ respectively. If the coin signals x each fall within the respective windows W the microprocessor determines that the coin is of a particular denomination and energises the solenoid operated accept gate 2 such that the coin is directed to the accept chute 3 (FIG. 1).

Referring now to FIG. 3, this shows the distribution of values of the coin signals $x_1$, $x_2$, $x_3$ produced for a distribution of coins of a particular denomination fed through the validator. For example, if a hundred coins of a particular denomination e.g. UK 5p were fed through the validator, the distribution of the values of the coin signals $x_1$, $x_2$, $x_3$ as a function of coin number n is shown by the distribution curves referenced T. Thus, conventionally, it has been considered that the windows W stored in the EEPROM 7 should have window widths $W_{1\,1}$, $W_{2\,1}$, $W_{3\,1}$. These window widths are substantially coextensive with the width of the distributions T of values of $x_1$, $x_2$, $x_3$. Thus conventionally, the microprocessor 6 determines whether the respective signals from a particular coin under test $x_1$, $x_2$, $x_3$ fall within the window ranges $W_{1\,1}$, $W_{2\,1}$ and $W_{3\,1}$. If all three conditions are satisfied the coin is accepted to be of a particular denomination corresponding to the stored window widths but otherwise is determined not to be of the particular denomination. Further sets of windows may be stored in the EEPROM corresponding to different denominations and the microprocessor maybe arranged to check against all sets of windows. If the coin is found not to be of a stored denomination, it is rejected due to the fact that the microprocessor does not operate the accept gate 2 and consequently, the coin passes to the reject chute 4 (FIG. 1).

Whilst this arrangement is generally satisfactory, a problem arises in that certain fraudulent coins have produced distributions of values of coin signals $x_1$, $x_2$, $x_3$, referenced F in FIG. 3, which overlap the distributions T for a true coin. Thus, it is possible for a fraudulent coin to produce a set of coin signals $x_1$, $x_2$, $x_3$ which fall within the window widths $W_{1\,1}$, $W_{2\,1}$, $W_{3\,1}$. Thus, the fraudulent coin would be accepted as a true coin.

In accordance with the invention, two alternative acceptance conditions are provided. This is achieved by programming two window widths in association with the windows $W_1$, and $W_2$.

Considering firstly the sensor coil C1, the window $W_1$ for this coil has a first window width $W_{1\,1}$ and a second window width $W_{1\,2}$. These window widths are shown schematically in FIG. 3*a*. The first window width $W_{1\,1}$ corresponds to the width of the true coin distribution T and is stored in the EEPROM 7 as lower and upper limits a, b respectively.

The second window width $W_{1\,2}$ corresponds to the range of values of $x_1$ for which the distributions F, T do not overlap, i.e. values which are unambiguously associated with a true coin. The window width $W_{1\,2}$ is stored as lower and upper limits 1, b in the EEPROM 7. Thus, the second window width $W_{1\,2}$ corresponds to the width of the true coin distribution T but excludes the values associated with the false coin.

Similarly, the sensor C2 has an associated second window $W_2$ with first and second window widths $W_{2\,1}$, $W_{2\,2}$.

The first window width $W_{2\,1}$ corresponds to the entire width of the true coin distribution T and is held in EEPROM 7 as lower and upper limits e, f. The second window width $W_{2\,2}$ corresponds to the width of the distribution T but excludes therefrom values associated with the false coin distribution F and is stored as lower and upper limit values m, f in the EEPROM 7.

The characteristic of the sensor coil 3 is such that the true and false coin distributions F, T are substantially similar for the coin signal $x_3$ and consequently, the window $W_3$ is stored with only one window width defined by lower and upper limits c, d corresponding to the width of the true coin distribution.

In accordance with the invention the microprocessor tests for a first acceptance condition for a particular set of coin signals $x_1$, $x_2$, $x_3$ as follows:

$$a \leqq x_1 \leqq b;\ m \leqq x_2 \leqq f;\ c \leqq x_3 \leqq d \qquad (1)$$

If the values of the coin signals $x_1$, $x_2$, $x_3$ satisfy the first condition (1) the coin is accepted as being of a particular denomination. If the coin signals do not satisfy condition (1), the microprocessor 6 determines whether the coin signals satisfy a second acceptance condition as follows:

$$1 \leqq x_1 \leqq b;\ e \leqq x_2 \leqq f;\ c \leqq x_3 \leqq d \qquad (2)$$

If the coin signals satisfy condition (2) the coin is accepted as being of the particular denomination; otherwise the coin is determined not to be of the particular denomination.

The microprocessor may then run through similar tests for different windows corresponding to different coin denominations.

The various window widths $W_{1\,1}$, $W_{1\,2}$, $W_{2\,1}$, $W_{2\,2}$, $W_3$ can be programmed into the EEPROM, typically, but not necessarily during manufacture of the validator. The window widths may be determined during a setup phase during which a number of true coins and false coins are passed through a validator to determine the distribution F and T discussed in relation to FIG. 3.

The advantage of providing the first and second acceptance conditions (1, 2) is that a substantially improved discrimination between true coins and fraudulent coins of similar characteristics is provided. The first and second acceptance conditions (1,2) are so arranged that each includes a window width $W_{1\,2}$, $W_{2\,2}$ which corresponds to a range of values of coin signal unambiguously associated with a true coin. The other two requirements of each acceptance condition provide an indication that the coin generally corresponds to the expected distribution T for the particular coin signal. In this way substantially improved coin discrimination between true and fraudulent coins is achieved. Whilst in the foregoing, coin signals x are digitised amplitude deviations, it will be appreciated that they can be produced in other ways e.g. in terms of a frequency deviation. Also, sensors other than inductive coil sensors could be utilised.

I claim:

1. Coin discrimination apparatus comprising:

means defining a path for the passage of coins under test, first and second sensor means for sensing a coin during its passage along the path, means responsive to said sensor means for producing first and second coin signals for the first and second sensor means respectively, the coin signals having values in dependence upon the coin under test, memory means storing data for defining first and second windows each having a width for acceptable values of the coin signals, and, means for comparing said coin signals with data stored in said memory to determine if the coin signals fall within the windows, wherein the data for the first and second windows are stored respectively for providing both a first and a second window width, wherein the first window width corresponds to the width of a distribution of coin signals associated with acceptable coins of a particular denomination, and the second window width corresponds to the width of said distribution but excludes therefrom a range of values corresponding to fraudulent coins, and a coin under test is deemed to be acceptable upon the coin signals falling either within a first or a second acceptance condition wherein, for the first acceptance condition, the value of the first coin signal falls within the first window width of the first window ($W_{11}$), and the value of the second coin signal falls within the second window width of the second window, and for the second acceptance condition the value of the first coin signal falls within the second window width of the first window, and the value of the second coin signal falls within the first window width of the second window.

2. Apparatus according to claim 1 including a third sensor means for sensing the passage of a coin along the path for producing a third coin signal, said memory means storing data for defining a third window of a width corresponding to the width of a distribution of coin signals associated with acceptable coins of said particular denomination, wherein said first and second acceptance conditions require the third coin signal to be within the width of the third window.

3. Apparatus according to claim 1 wherein said memory means includes data for defining a plurality of sets of windows corresponding to coins of different denominations.

4. Apparatus according to claim 1 wherein the memory means comprises an EEPROM.

5. Apparatus according to claim 1 wherein said comparing means comprises a microprocessor.

6. Apparatus according to claim 1 wherein each of said sensor means includes a plurality of inductive sensor coils arranged to produce respective different inductive couplings with a coin under test.

7. Coin discrimination apparatus according to claim 1 including an accept gate operated to accept a coin in response to said first or second acceptance condition.

8. A method of discriminating between coins comprising the steps of:

performing first and second tests upon a coin so as to develop first and second coin signals in dependence upon the coin under test;

storing data for a first window and a second window for respectively providing both a first and a second window width, wherein the first window width corresponds to the width of a distribution of coin signals associated with acceptable coins of a particular denomination, and the second window width corresponds to the width of said distribution but excludes therefrom a range of values corresponding to fraudulent coins;

comparing said first and second coin signals with said first and second windows; and accepting a coin upon the coin signals falling either within a first or a second acceptance condition, wherein said first acceptance condition is achieved when the value of the first coin signal falls within said first window width of said first window and the value of the second coin signal falls within said second window width of said second window, and wherein said second acceptance condition is achieved when the value of the first coin signal falls within said second window width of said first window and the value of the second coin signal falls within said first window width of said second window.

9. A method according to claim 8 further comprising the steps of performing a third test on the coin to produce a third coin signal, and comparing the third coin signal with a third window, wherein the first and second acceptance conditions require the third coin signal to be within the width of the third window.

10. A method according to claim 8 further comprising the steps of comparing the coin signals with a plurality of sets of windows corresponding to coins of different denominations.

* * * * *